US005452044A

United States Patent [19]

Devaney, Jr.

[11] Patent Number: 5,452,044

[45] Date of Patent: Sep. 19, 1995

[54] PROCESSING APPARATUS

[75] Inventor: Mark J. Devaney, Jr., Rochester, N.Y.

[73] Assignee: Eastman Kodak Company, Rochester, N.Y.

[21] Appl. No.: 54,501

[22] Filed: Apr. 27, 1993

[51] Int. Cl.[6] ..... G03D 3/02; G03D 3/04

[52] U.S. Cl. ..... 354/324; 354/328; 354/331; 354/336

[58] Field of Search ..... 354/319–324, 354/331, 328, 336; 134/64 R, 64 P, 122 P, 122 R

[56] References Cited

U.S. PATENT DOCUMENTS

| | | | |
|---|---|---|---|
| 2,621,572 | 12/1952 | Luboshez | 354/317 |
| 3,344,729 | 10/1967 | Kitrosser | 354/321 X |
| 3,673,985 | 7/1972 | Dols | 118/637 |
| 3,774,521 | 11/1973 | Beck | 354/317 |
| 4,233,385 | 11/1980 | Hinz et al. | 430/117 |
| 4,247,191 | 1/1981 | Grace et al. | 355/4 |
| 4,359,279 | 11/1982 | Popoff | 354/320 |
| 4,736,221 | 4/1988 | Shidara | 354/328 |
| 4,791,444 | 12/1988 | Fujimoto et al. | 354/324 |
| 4,929,975 | 5/1990 | Shidara | 354/317 |
| 4,989,028 | 1/1991 | Hall et al. | 354/324 |
| 4,994,840 | 2/1991 | Hall et al. | 354/324 |
| 5,023,644 | 6/1991 | Kurematsu et al. | 354/320 |
| 5,043,756 | 8/1991 | Takabayashi et al. | 354/320 |
| 5,059,997 | 10/1991 | Hall et al. | 354/324 |
| 5,189,457 | 2/1993 | Schlee et al. | 354/328 |
| 5,190,450 | 3/1993 | Ghosh et al. | 418/189 |
| 5,294,956 | 3/1994 | Earle | 354/324 |

FOREIGN PATENT DOCUMENTS

| | | | |
|---|---|---|---|
| 4-83251 | 3/1992 | Japan | 354/324 |
| 433012 | 3/1967 | Switzerland | 354/320 |
| WO9212465 | 7/1992 | WIPO . | |

*Primary Examiner*—D. Rutledge
*Attorney, Agent, or Firm*—Charles E. Snee, III

[57] ABSTRACT

A processor for light sensitive material includes a processing device which is immersed in processing liquid in a processing chamber and defines a processing channel through which a web is transported by transport rollers for contact with a treatment liquid. Liquid is injected into the channel at one or more injection sites and evacuated from the channel at one or more evacuation sites. A pump which is totally immersed in the liquid circulates liquid from within the chamber to the evacuation sites and through the processing channel to the evacuation sites.

In one embodiment of the pump comprises an elongated cylindrical element having a plurality of peripheral blades and positioned in close proximity to manifold elements which define high pressure zones adjacent the injection sites. In another embodiment the pump comprises an elongated gear pump.

The processor may include a plurality of such chambers and a plurality of such processing devices and pumps. Transport rollers between adjacent chambers serve to transport the web from chamber to chamber through the processor. Each set of transport rollers and the drive gears therefore is supported in a removable module. Similarly each processing device and the associated pump and drive gears for the pump are supported in a removable module. Indexing surfaces define the operative positions of the modules. Central drive shafts having a plurality of gears drive the gear drives of the modules when the modules are in their operative positions.

41 Claims, 16 Drawing Sheets

PROCESSING APPARATUS

CROSS REFERENCE TO RELATED APPLICATIONS

Reference is made to the following commonly assigned copending applications:

1) Ser. No. 07/633,490 filed Dec. 28, 1990 by Lee F. Frank and entitled "Processor for Light Sensitive Material", now U.S. Pat. No. 5,239,327 granted 24 Aug. 1993; and
2) Ser. No. 08/054,487 filed Apr. 27, 1993 by Mark J. Devaney, Jr. and John S. Letcher and entitled "Thru-Wall Web Processing Apparatus".

TECHNICAL FIELD

This invention relates to apparatus for subjecting web material to treatment and more particularly to apparatus for processing light sensitive material such as photographic film or paper.

BACKGROUND ART

Many conventional photographic processors comprise a plurality of tanks containing various processing fluids, each tank having a plurality of rollers for transporting the light sensitive material therethrough. A web of light sensitive material in continuous or sheet form is transported through the tanks in a generally sinusoidal path. The web is continuously contacted by the rollers leading to possible scratching of the light sensitive material. Typically, the rollers are driven so that the surface speed of the rollers matches the speed of the light sensitive material. Any agitation of the fluid is the result of the relative motion between the fluid and light sensitive material.

A variety of photographic processors have been proposed which attempt to reduce the contact between light sensitive material and drive rollers to thereby reduce the possibility of scratching or marring of the material being processed. The proposed processors aim for uniform distribution of the processing fluid directed onto the light sensitive material to obtain uniform development of the material. Such processors also aim for increased chemical transfer rates to and from the light sensitive material being processed. They also attempt to contain the processing fluids within their respective tanks to prevent contamination of the processing fluids.

Conventional film or paper processes generally use external pumps to circulate processing fluids within the processor tanks to insure constant mixing of bulk solutions and in some cases to provide agitation of the solutions near the surface of the film. In most cases these pumps require external connections to the tank resulting in maintenance problems due to leakage at the connections. In addition a substantial amount of energy is expended in moving fluid through the restrictive plumbing system.

Some of the problems discussed above are alleviated by the processor designs disclosed in commonly assigned U.S. Pat. Nos. 4,994,840 and 4,989,028 to Hall et al; U.S. Pat. No. 5,136,323 to Frank et al; U.S. Pat. No. 5,172,153 to Lee F. Frank et al; and copending application Ser. No. 07/633,490 filed Dec. 28, 1990 by Lee F. Frank. Such patents and applications disclose processing apparatus which process a web while it is positioned in a plane or transported through a path without the use complicated roller transport apparatus. In U.S. Pat. Nos. 5,136,323 and 5,172,153 there are disclosed parallel plate processors which transport a web through a treatment channel having one or more fluid injection sites at which fluid is injected into the channel on opposite sides of the web. The channel has one or more evacuation sites spaced from the injection sites for evacuating fluid from the channel. The parameters of the system are selected such that the chemical boundary layer of the processing fluid has a thickness to maintain a chemical transfer rate in the fluid that exceeds the chemical transfer rate in the web. In U.S. application Ser. No. 07/633,490 there is disclosed a processor comprising a plurality of hydrostatic bearings for supporting and processing a web of light sensitive material. Processing fluid is supplied to the bearings by a pump in a separate chamber. While such systems are capable of achieving efficient processing of light sensitive web material in continuous form or in sheet form they utilize external pumps or plumbing to circulate the processing fluid and/or do not uniformly distribute the processing fluid across the width of the web being processed.

DISCLOSURE OF THE INVENTION

It is an object of the present invention to provide a processor for treating a web which utilizes a submerged pump means for circulating fluid from within a processing chamber into uniform contact with the entire width of the web.

In accordance with one embodiment of the invention a processing device for light sensitive material is immersed in treatment fluid in a processing chamber and defines a channel through which a web is transported by web transport means for contact with a treatment fluid. Means directly associated with the processing device in the chamber circulates processing fluid from within the chamber through the processing device. This arrangement reduces the plumbing required and substantially increases the efficiency and simplicity of the processor.

In accordance with another feature of the invention the processing device and web transport means are contained within modules which are removably supported within the processor. Alignment means are provided for aligning the modules in operative relationship with each other and associated drive means.

BRIEF DESCRIPTION OF THE DRAWINGS

Other objects and advantages will become apparent from the following description presented in connection with the accompanying drawings wherein.

MODE OF CARRYING OUT THE INVENTION

Figure 1:
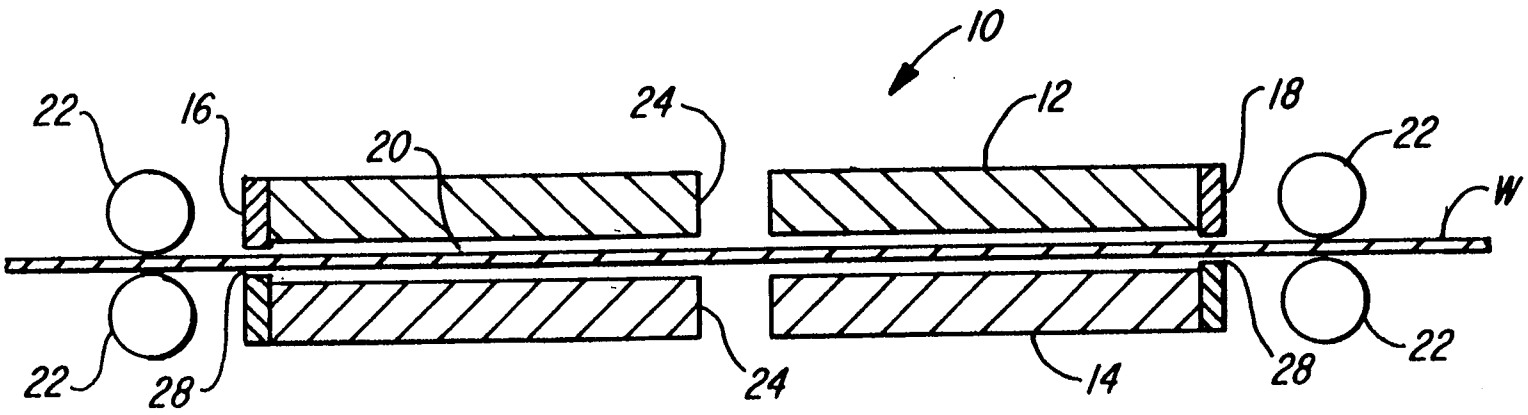
FIG. 1 is a schematic illustration of a simple parallel plate processor.

Referring to FIG. 1 of the drawings there is shown a basic parallel plate processor 10 for processing light sensitive material comprising a web W in continuous or sheet form. In general the processor 10 comprises a pair of parallel plates 12 and 14 supported in spaced relationship by end plates 16 and 18 to define a channel or recess 20 for movement of the web therebetween by rollers 22. The plates are provided with juxtaposed injection slits 24 which extend transversely of the web path respectively for injecting fluid into the channel 20 on opposite sides of the web at a fluid injection site. The fluid so injected will form fluid cushions on opposite sides of the web and will flow in opposite directions along the web to be evacuated at evacuation slits 28 in end plates 16 and 18 respectively. This basic parallel plate processor structure is more fully disclosed and described In commonly assigned U.S. Pat. No. 5,136,323, the disclosure of which is incorporated herein by reference. As disclosed in U.S. Pat. No. 5,136,323 the parameters of the system are selected such that the fluid will be evacuated from the channel 20 when the fluid boundary layer reaches a predetermined thickness so that the chemical mass transfer rate to the web in channel 20 exceeds the chemical mass transfer rate within the web.

Figure 2:
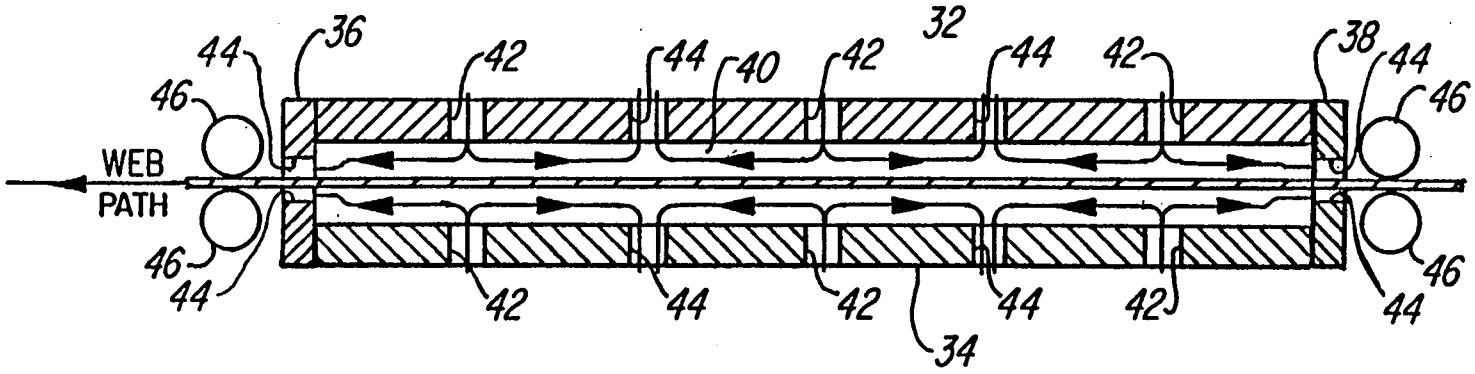
FIG. 2 is a schematic illustration of another embodiment of a parallel plate processor.

Another embodiment of a parallel plate processor is shown in FIG. 2. In this embodiment a pair of parallel plates 32 and 34 are supported in spaced relationship by end plates 36 and 38 to define a web channel or recess 40. The plates 32 and 34 are provided with a plurality of juxtaposed transverse fluid injection slits 42 and a plurality of juxtaposed transverse evacuation slits 44 along the length of the web channel. A web W is transported through the channel 40 by rollers 46.

In the FIG. 2 embodiment the injection slits 42 and evacuation slits 44 are placed in alternating pattern such that on each side of the web an injection slit 42 is located between two evacuation slits 44. When fluid under pressure is supplied to the injection slits 42 fluid will flow in opposite directions from each injection slit to the adjacent evacuation slits 44 where it will be evacuated, such flow pattern being indicated by the arrows in FIG. 2. As in the case of the FIG. 1 embodiment the injection slits are spaced from the evacuation slits by a distance such that the fluid is evacuated when its boundary layer reaches a predetermined thickness to maintain the chemical mass transfer rate to the web greater than that within the web. Such a multi slit processor is more fully disclosed and described in U.S. Pat. Nos. 5,136,323 and 5,172,153 cross referenced above and further description is deemed unnecessary.

Figure 3:
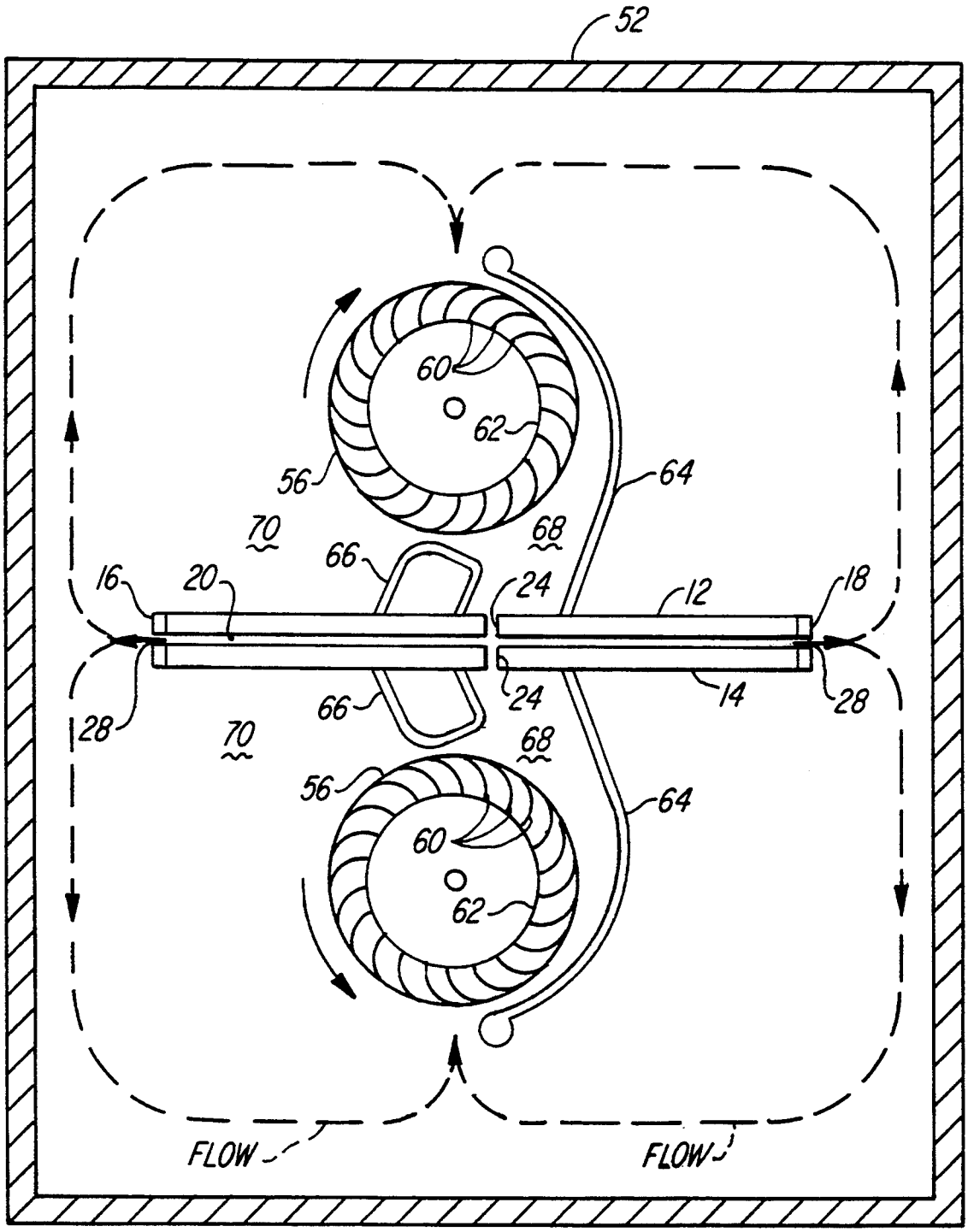
FIG. 3 is a schematic illustration of a transverse pump processing cell in accordance with the invention.
Figure 4:
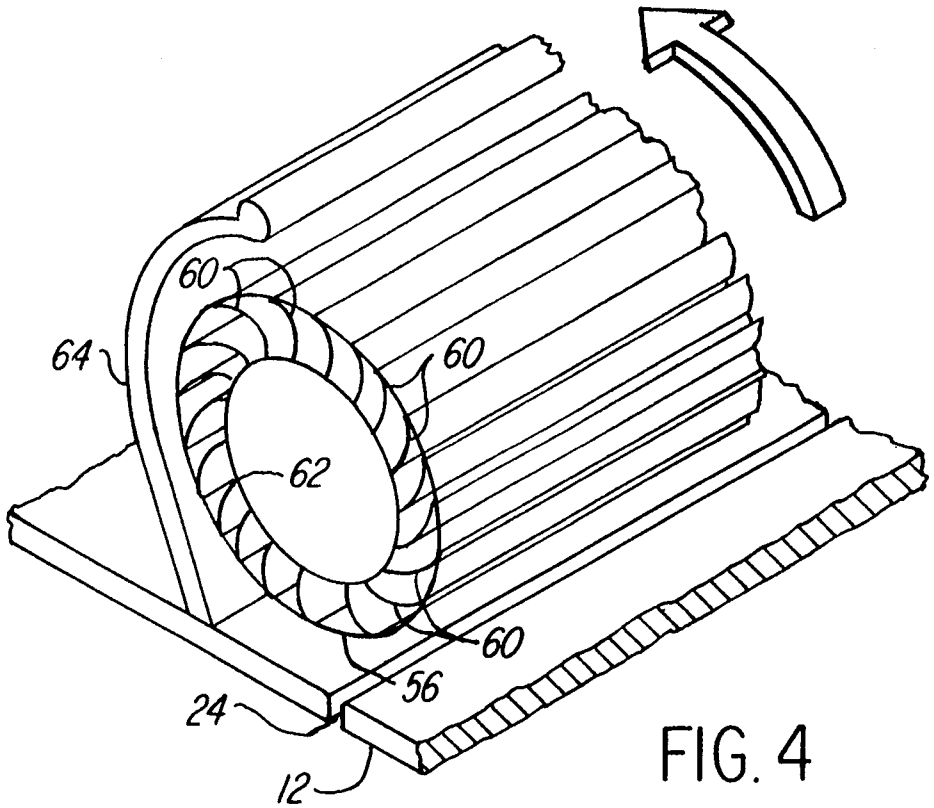
FIG. 4 is an enlarged perspective of a pump element shown in FIG. 3.

Referring to FIGS. 3 and 4 of the drawings there is shown a basic immersed pump processor in accordance with the invention. FIG. 3 illustrates the inventive concept applied to the basic parallel plate processor of FIG. 1. However, it will be apparent from the ensuing description that the inventive concept is applicable to the multi slit processor of FIG. 2.

Referring specifically to FIGS. 3 and 4 the processor includes a tank or housing 52 which may be supplied with processing or washing fluid by suitable plumbing (not shown). The plates 12 and 14 are supported in the housing 52 whereby the housing encloses and contains the space surrounding the injection slits 24. A pair of elongated rotatable transverse pumps 56 are positioned within the housing 52 above and below the plates 12 and 14 respectively. Each of the pumps comprises an elongated cylindrical element having a plurality of curved blades 60 dispersed around its periphery and extending radially outward from a peripheral surface 62 as shown most clearly in FIG. 4. Preferably each pump element has a length at least equal to the length of its associated injection slit and is positioned adjacent to such slit in substantially parallel relationship therewith as shown in FIG. 3. Each pump element is rotated by a motor means (not shown) in the direction indicated by the arrows.

Positioned within the housing 52 are elongated curved manifold elements 64 extending from the plates 12 and 14 respectively. The ends of the manifold elements terminate adjacent the periphery of their associated pump elements 56. The manifold elements 64 cooperate with manifold elements 66 respectively to define high pressure regions 68 adjacent the associated injection slit and low pressure regions 70 adjacent the remaining peripheral surface of the pump elements 56 respectively. Similar to the pump elements 56 the manifold elements 64 and 66 extend transversely of the channel 20 and preferably have a length at least equal to that of the injection slits 24.

In operation of the processor depicted in FIGS. 3 and 4, fluid within the housing 52 will enter the vanes 60 from the low pressure regions 70 and flow out the other side of the pump element into the high pressure regions 68. If the pump elements 56 are rotated in the directions indicated by the arrows the fluid will be transferred from the regions 70 to the regions 68 to produce fluid under pressure in regions 68. This action will supply fluid under pressure from regions 68 to the adjacent injection slits respectively to inject fluid into the channel 20. Since the entire assembly shown in FIG. 3 is immersed in the tank or housing 52, circulation within the housing returns fluid evacuated from the evacuation slits 28 to the pump elements 62 in the housing 52 respectively as indicated schematically.

The advantages of the apparatus depicted in FIGS. 3 and 4 will now be apparent. Because the pump elements are totally immersed the need for external plumbing is minimized. Also the efficiency of the apparatus is high since energy is not expended in moving fluid through a restrictive plumbing system. The immersed pumps also provide high in-tank solution turnover and achieve thorough mixing of the evacuated fluid with replenishment fluid.

Figure 5:
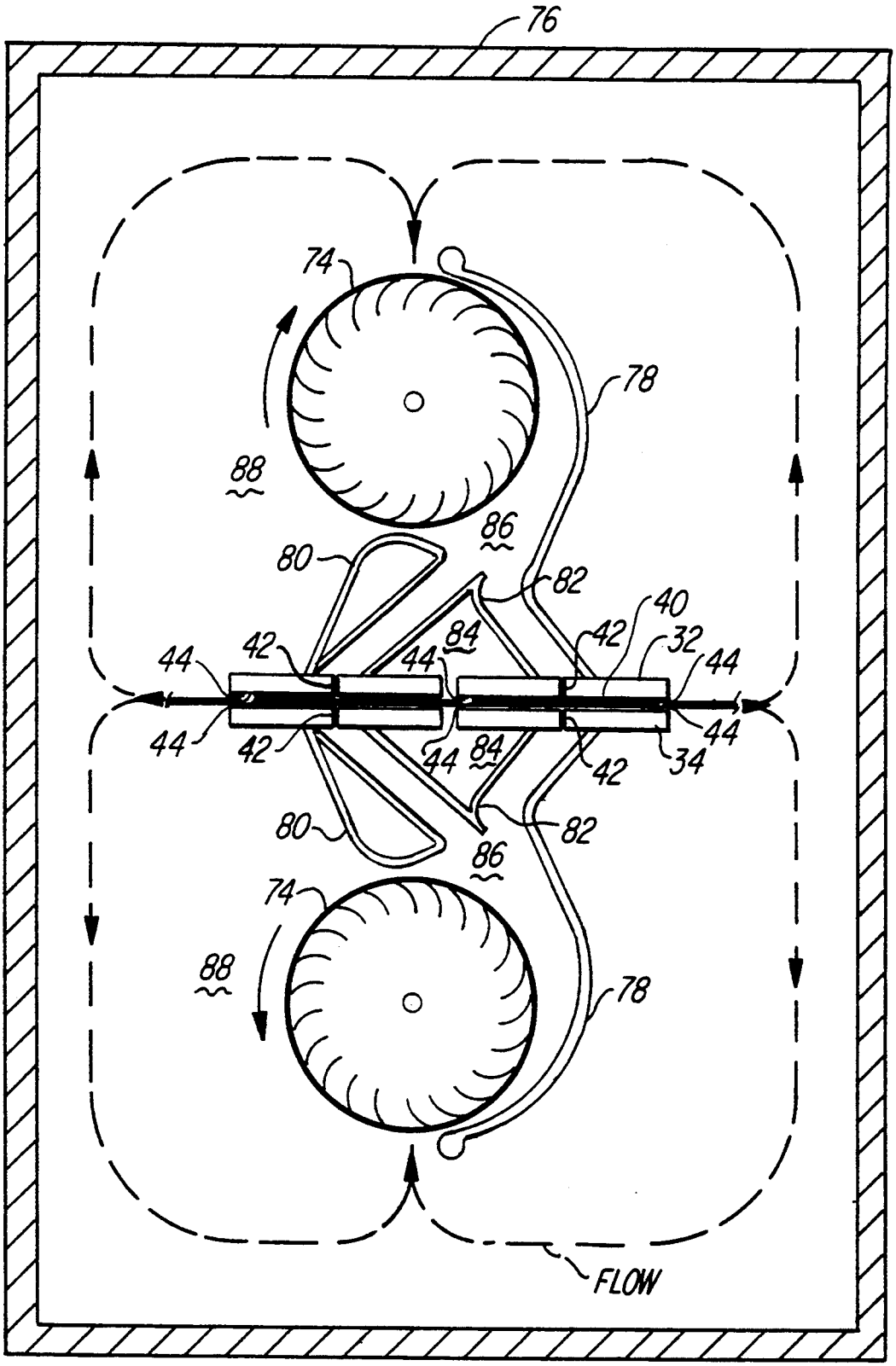
FIG. 5 is a schematic illustration similar to FIG. 3 illustrating another embodiment of the invention.

Referring to FIG. 5 of the drawings another embodiment of the invention is shown wherein each transverse pump serves a plurality of (in this case 2) injection sites of a multi slit parallel processor of the type shown in FIG. 2. More specifically there is shown in FIG. 5 a portion of the plates 32 and 34 including three pairs of juxtaposed evacuation slits 44 alternating with two pairs of juxtaposed injection slits 42.

Similar to the FIG. 3 embodiment the apparatus of FIG. 5 includes transverse pump elements 74 on opposite sides of the plates 32 and 34 which are rotatable in the directions indicated by the arrows by motor means (not shown). The pump elements 74 are identical to the elements 56 of FIG. 3. The entire assembly is immersed in fluid in a housing 76 similar to the housing 52 of FIG. 3.

In the FIG. 5 embodiment manifold elements 78 extend from the plates 32 and 34 respectively at the right side of one injection site and terminate in close proximity to the periphery of the pump elements 74 respectively. Manifold elements 80 extend from the plates 32 and 34 respectively at the left side of the other injection sites. Third manifold elements 82 extend from the plates 32 and 34 respectively and define evacuation chambers 84 in communication with the evacuation slits 44 respectively and the exterior of the assemblies. The manifold elements 78, 80 and 82 cooperate to define high pressure regions 86 on opposite sides of the evacuation slits 44 in communication with the injection slits 42 and low pressure regions 88 in communication with peripheries of the pump elements. Similar to the FIG. 3 embodiment the assemblies shown in FIG. 5 are preferably totally immersed in processing or washing fluid within housing 76. In operation of each assembly rotation of the pump elements 74 will cause fluid to be transferred from low pressure regions 88 to high pressure regions 86. The fluid under pressure in regions 86 will enter channel 40 via injection slits 42 and establish fluid cushions on opposite sides of the web W. Fluid will flow in opposite directions from each injection slit to an adjacent evacuation slit where it is evacuated into the housing 76. The provision of two injection slits produces a large increase in the average chemical transfer coefficient over the width of the processing cell.

While only two juxtaposed pump assemblies are shown in FIG. 5 it will be apparent that a plurality of such assemblies can be provided along the length of plates 32 and 34 to serve combinations of injection and evacuation sites.

Figure 6:
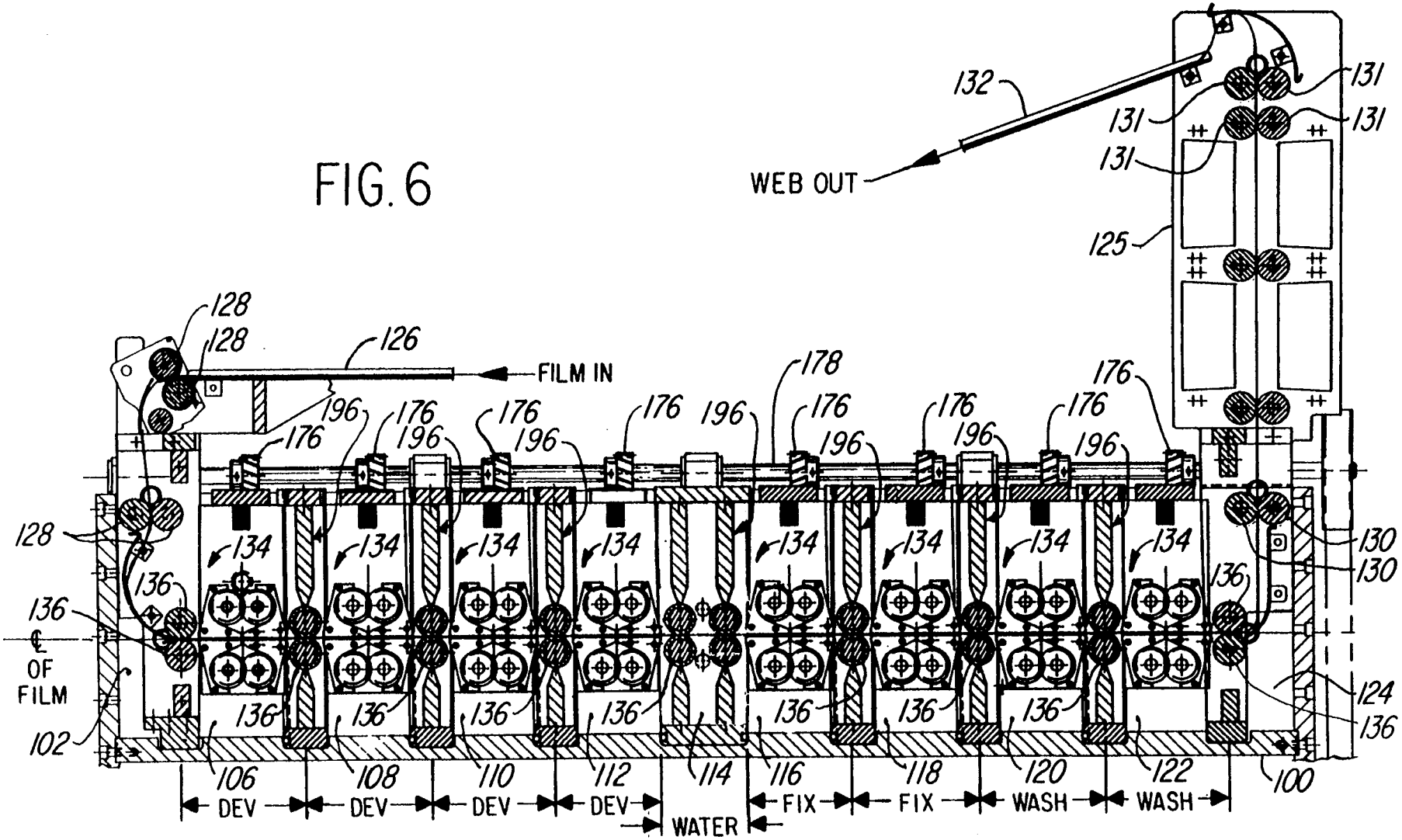
FIG. 6 is a side view of processing apparatus incorporating the invention.

Referring to FIG. 6 of the drawings there is shown a preferred embodiment of a film or paper web processor for sequentially contacting the web with developer, fix and wash solutions by transporting it through a plurality of chambers. Each such chamber contains a parallel plate type processor and a preferred embodiment of a transverse pump module in accordance with the invention. More specifically the apparatus depicted in FIG. 6 comprises an elongated housing 100 divided by suitable partitions to define a web entrance chamber 102, a series of developing chambers 106, 108, 110 and 112, a rinse chamber 114, a series of fixing chambers 116 and 118, a series of wash chambers 120 and 122, a web exit chamber 124 and a final drying module 125. The web is fed into the apparatus by an entrance chute 126 and transported through entrance chamber 102 by a series of transport rollers 128. The web is transported from the final wash chamber 122 to the drying module 125 by rollers 130 from which it is exited by additional rollers 131 and chute 132.

Each of the chambers 106–112 and 116–122 contains a preferred embodiment of a web processing module 134 in accordance with the invention. With respect to each module 134 rollers 136 are provided to transport the web into and out of the module. Similar rollers 136 are provided to transport the web through the rinse chamber 114.

Figure 7:
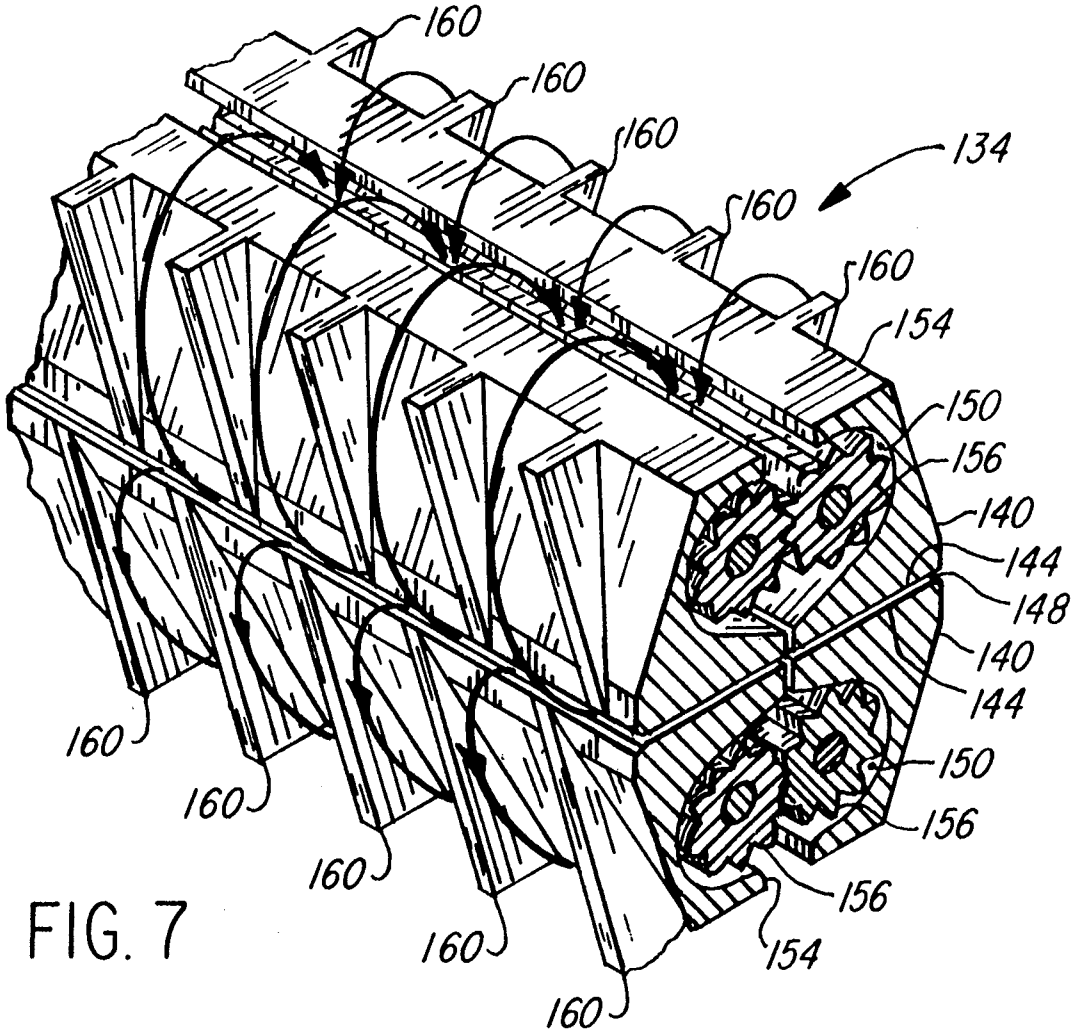
FIG. 7 is a perspective of a transverse pump processing module used in the apparatus depicted in FIG. 6.
Figure 9:
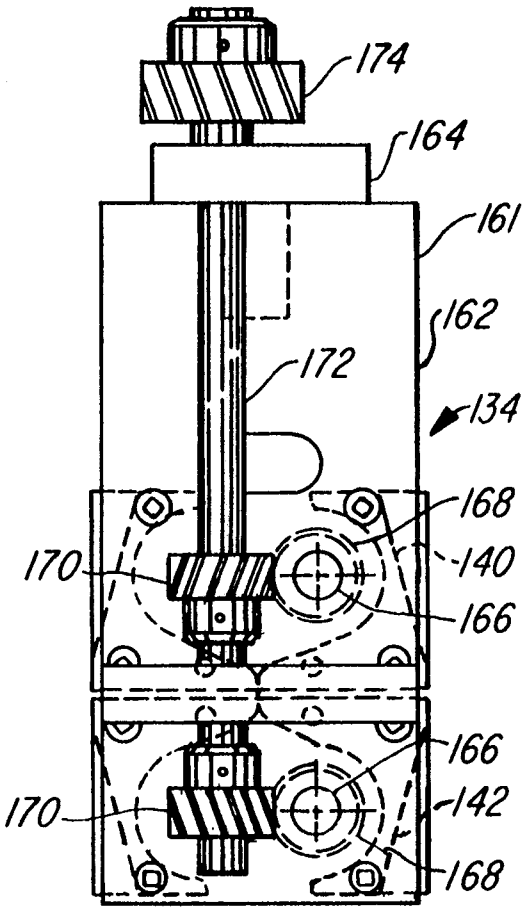
FIG. 9 is an end view of the apparatus shown in FIG. 8.
Figure 8:
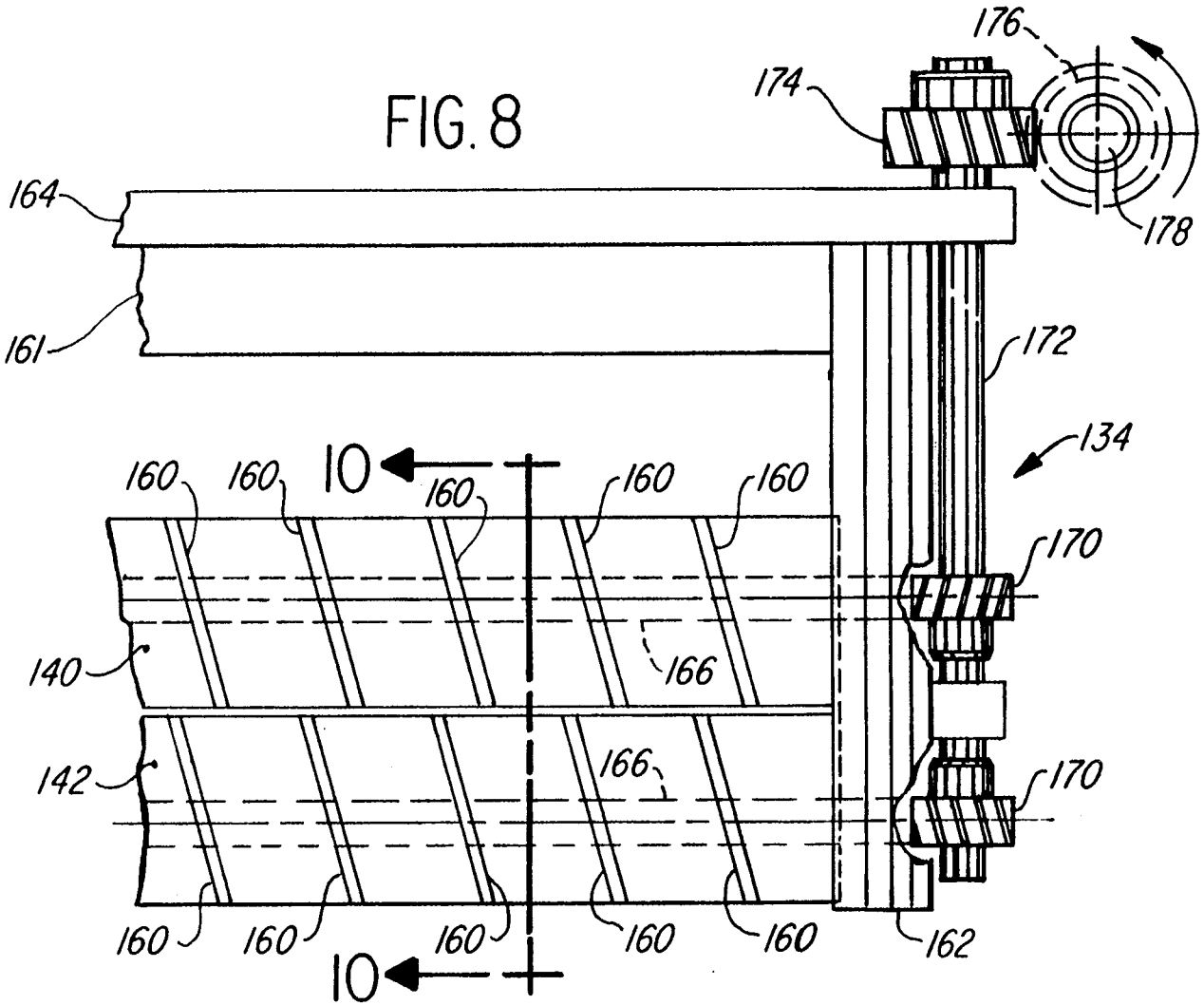
FIG. 8 is an enlarged side view of a transverse pump processing module and associated drive means.
Figure 10:
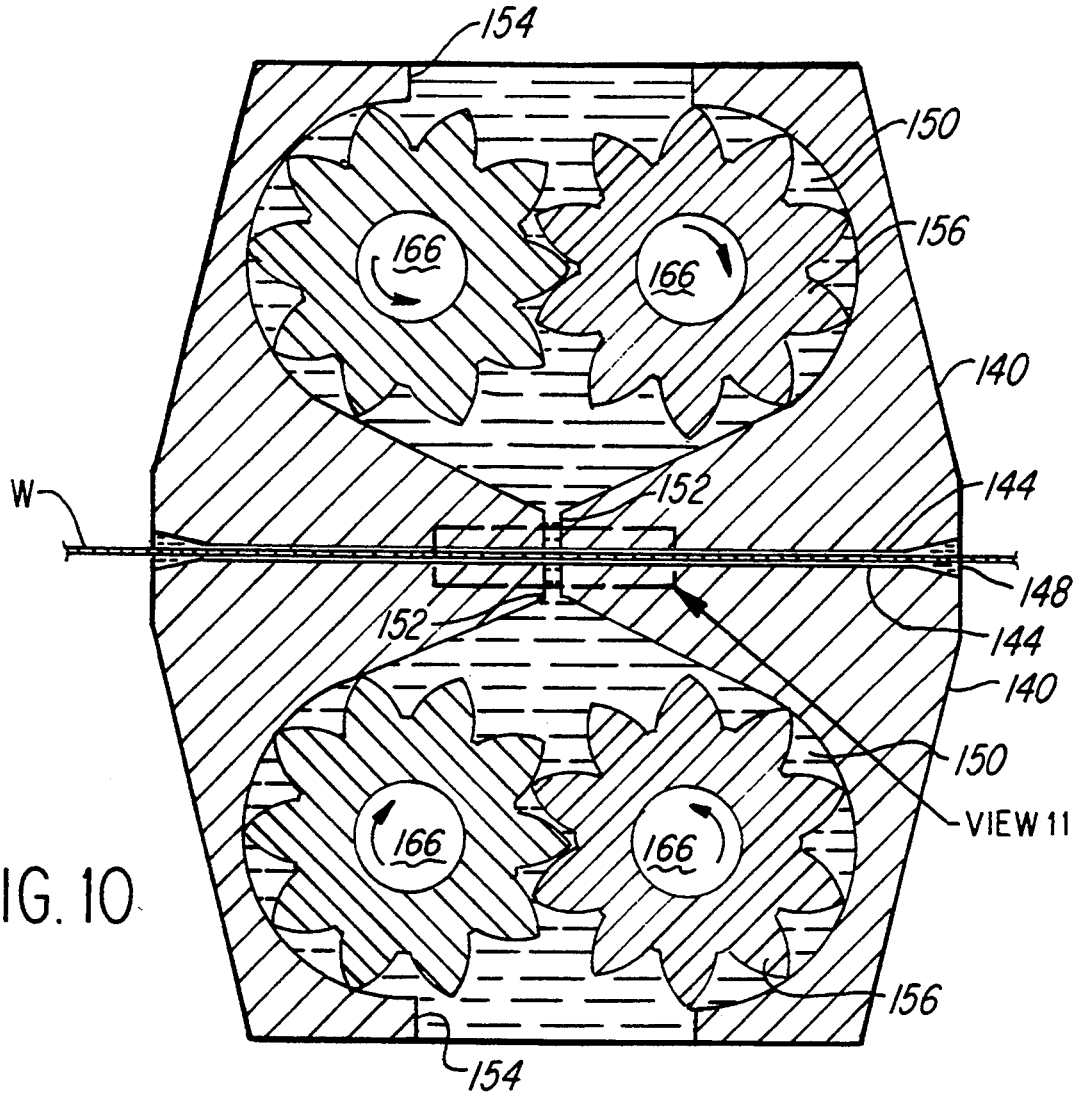
FIG. 10 is a section taken along the line 10—10 of FIG. 8.
Figure 11:
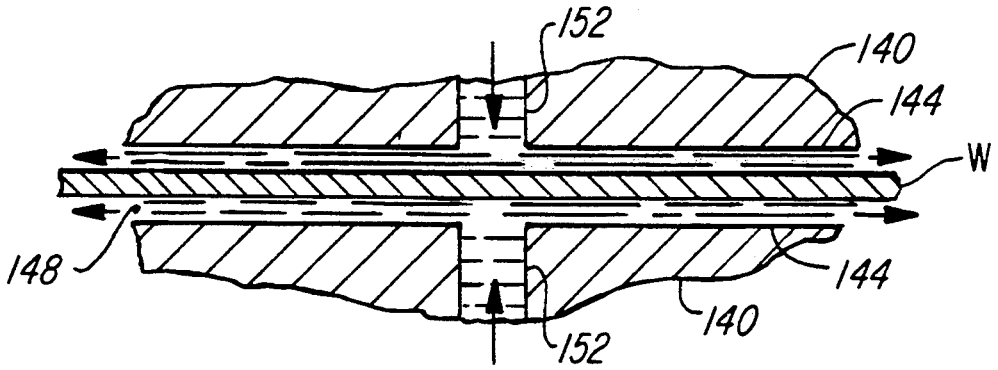
FIG. 11 is an enlarged detail of the area 11 of FIG. 10.

Referring now to FIGS. 7–11 and initially to FIGS. 7 and 10 each of the processing modules comprises a pair of elongated casings 140 supported with their face surfaces 144 in juxtaposed spaced parallel relationship to define a channel or recess 148 therebetween through which the web is transported by rollers 136 (FIG. 6). Each of the casings 140 has a heart shaped cavity 150 which communicates with a fluid injection slit 152 (FIGS. 10 and 11) extending between the cavity 150 and the web channel 148. The other side of each cavity 150 is provided with an opening 154 which permits circulation of fluid from the associated chamber into the casing 140 as described below.

A transverse gear pump comprises a pair of gear pump elements 156 rotatably mounted in each cavity 150 to pump fluid entering the cavity via opening 154 in to the region of the cavity adjacent slit 152. When the pump elements are rotated in the directions indicated in FIG. 10, fluid will be circulated through openings 154 to the regions adjacent slits 152 to create high pressure regions of fluid adjacent slits 152. This high pressure region of fluid in the casings 140 will inject fluid into channel 148 via slits 152 to create fluid cushions in channel 148 on opposite sides of the web and establish flow of fluid in opposite directions along the web to the ends of channel 148 where it will be evacuated into the chamber in which the module is supported. Preferably each processing module has a length at least equal to the maximum web width and extends transversely to the web path. Each processing module is totally immersed in the fluid of its respective chamber eliminating the need for external plumbing and associated fluid flow restrictions. When so immersed in the fluid of the associated chamber, fluid will flow into the openings 154 and be transferred by the pump elements 156 into the channel 148 via slits 152. Fluid evacuated from the ends of the channel 148 will flow through the chamber around the exterior of the module and back into the openings 154 such circulation being indicated by the flow lines and arrows in FIG. 7.

To insure circulation and mixing of the fluid in a direction transverse of the web path as well as in a direction longitudinal to the web path each module is provided with a plurality of spaced fins 160 (FIG. 7) on the exterior surfaces of the casings 140. These fins are preferably positioned in substantially parallel planes inclined at an angle of approximately 15 degrees relative to the longitudinal axis of the web as most clearly shown in FIGS. 7 and 8. Also the fins of casing 140 are not aligned with the fins of the juxtaposed casing 140. Such inclination and non alignment insures circulation of fluid along the length of each module transverse to the web path.

The pump gear elements 156 are rotated by an external drive means illustrated in FIG. 6 and in detail in FIGS. 8, 9, 12, 14 and 15. More specifically each module 134 is supported in a frame 161 (FIG. 8, 9 and 14) having side walls 162 and an upper wall 164. Each gear element 156 is mounted on a shaft 166 which extends externally of its module and is rotatably mounted on frame 161. As shown most clearly in FIG. 9, one shaft of each gear element pair is provided with a gear 168 which meshes with a gear 170 of a vertical drive shaft 172. The upper end of the shaft 172 is provided with a gear 174 which meshes with a gear 176 (FIG. 8) carried by an elongated shaft 178 extending along the upper portion of the processing apparatus as shown in FIG. 6. As indicated in FIG. 6 the shaft 178 is provided with a plurality of gears 176 for driving the pumps of the processing modules 134 supported in chambers 106–122 respectively.

Figure 12:
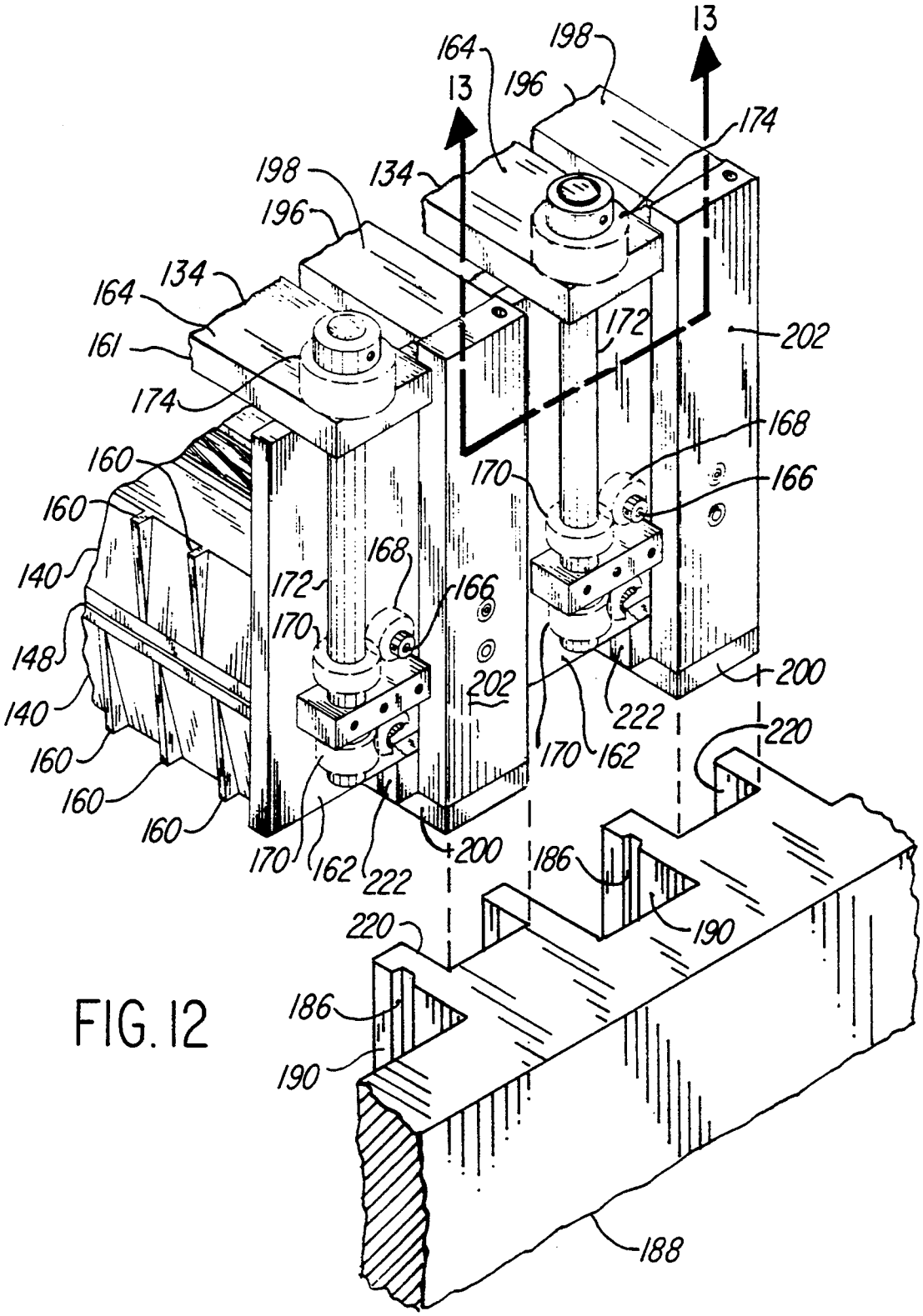
FIG. 12 is an exploded perspective view of a portion of a transverse pump processing module shown in FIGS. 6–10 illustrating the mounting of the module and drive means for the pump.
Figure 13:
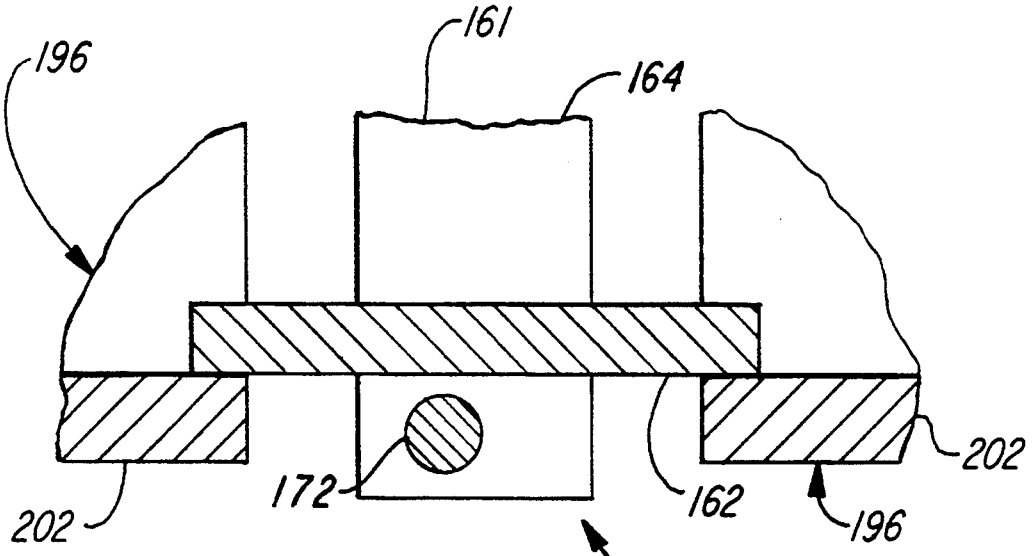
FIG. 13 is a section taken along the line 13—13 of FIG. 12.
Figure 14:
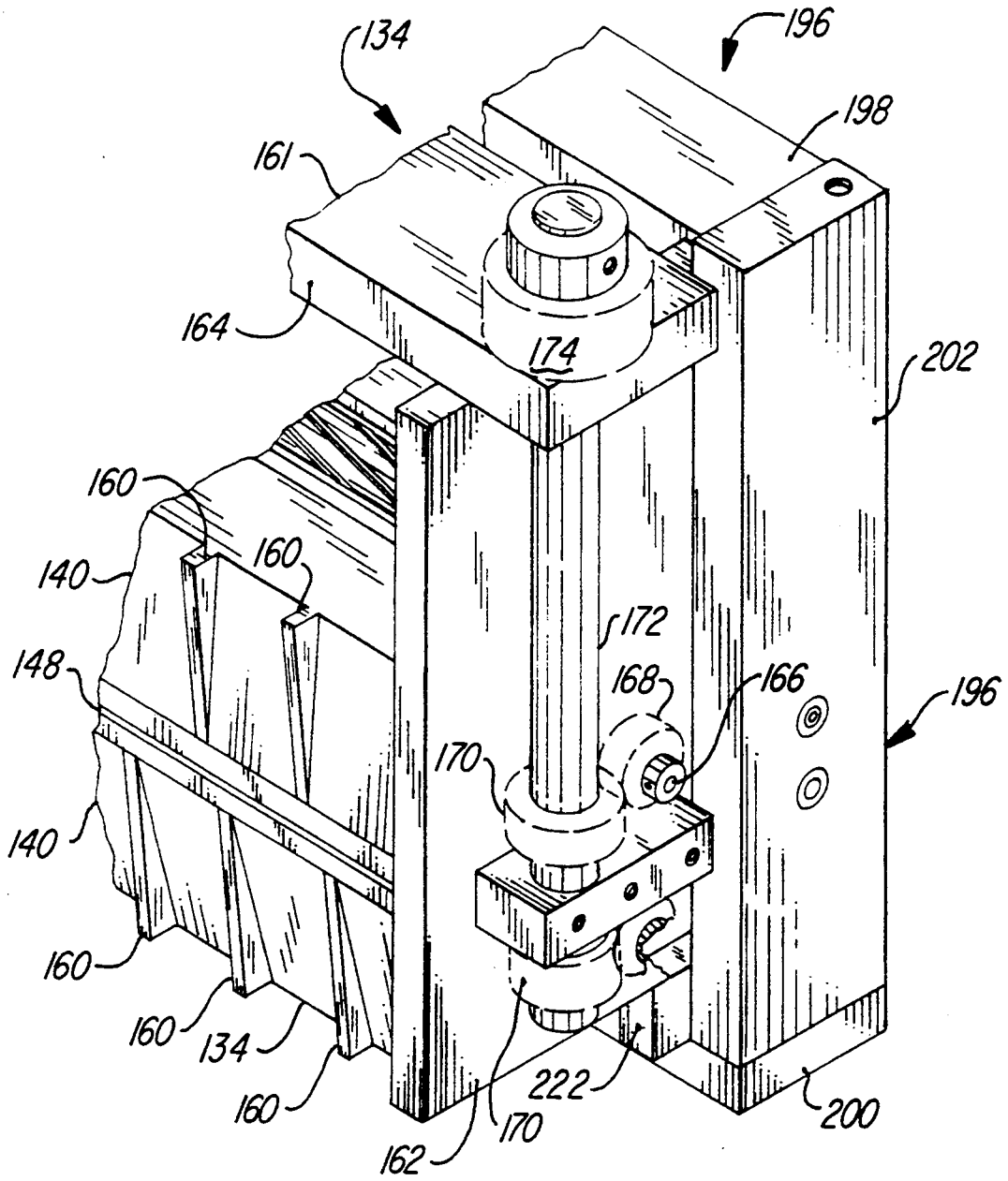
FIG. 14 is an enlarged perspective view showing in more detail a portion of the apparatus shown in FIG. 12.
Figure 15:
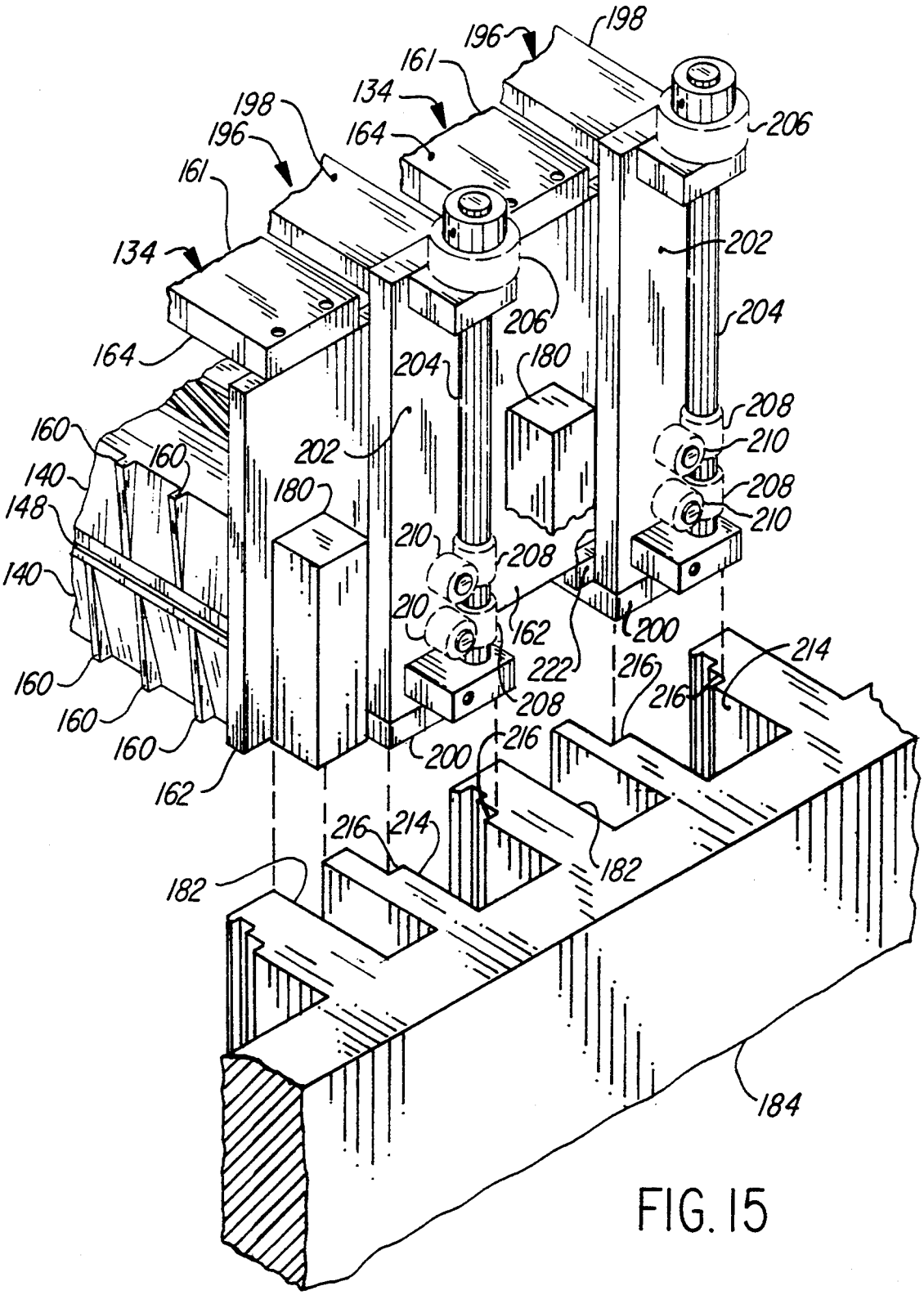
FIG. 15 is an exploded perspective view of a portion of a transverse pump processing module taken from a side opposite to that of FIG. 12 to illustrate the mounting of the module supporting the transport rollers and drive means for the transport rollers.
Figure 16:
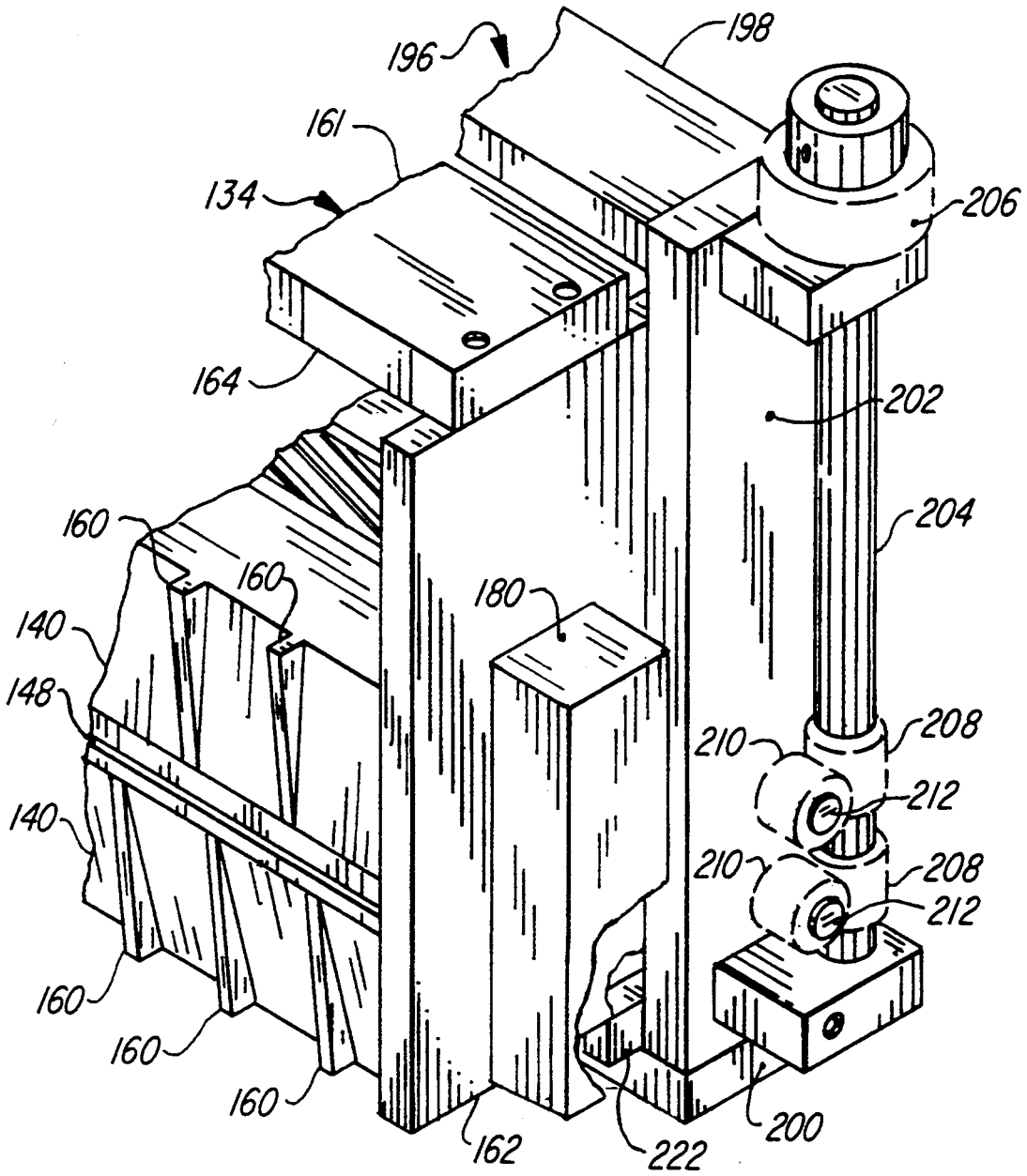
FIG. 16 is an enlarged perspective view of a portion of the apparatus shown in FIG. 15 showing some of the parts in more detail.

As shown most clearly in FIG. 15 each module 134 is provided with a guide or indexing means comprising a lug 180 on one of its end walls 162 which is slidably received by a complemental slot 182 in one side wall 184 of the processor, such lug and slot being effective to align one end of the module within the processor. As shown in FIG. 12, the opposite side wall 162 of each module 134 is received by a slot 186 in an opposite side wall 188 of the processor. Each slot 186 is formed in the surface of an elongated recess 190 which receives the shaft 172 and associated gears. Thus the edges of the sidewalls 162 and slot 186 align the other end of each module 134. Each module 134 is thus removably supported and aligned in an operative position in its associated processing chamber. When so positioned the gear 174 is engaged by gear 176 and its pumps are driven by shaft 178 and gears 170 and 168.

The transport rollers 136 dispersed between modules 134 are also rotatably supported in removable modules 196. As shown in FIGS. 6 and 12–16 and particularly FIGS. 14 and 16 each module 196 comprises an upper wall 198, bottom wall 200 and a pair of side walls 202. The drive means for the rollers of each module 196 comprises a vertical shaft 204 (FIGS. 15 and 16) extending along one end wall 202 and having a gear 206 on its upper end for engagement with a gear carried by a second elongated shaft (not shown) similar to shaft 178 extending along the upper portion of the processing apparatus. The lower end of the shaft 204 is provided with a pair of gears 208 which engage gears 210 carried on the ends of roller shafts 212 respectively. When the modules 196 are in their operative positions depicted in FIG. 6 their respective gears 206 will engage the gears of the second elongated shaft.

To support the modules 196 in the processor the side wall 184 is provided with a plurality of spaced recesses 214 (FIG. 15) alternating with the recesses 182. Each recess 214 receives the end wall of a module 196 with the edges of its end plate 202 engaging indexing edges 216. Each recess 214 is deep enough to receive the shaft 204 and associated gears. The other ends of the module 196 are received in slots 220 (FIG. 12) which alternate with slots 190 in wall 188. To complete the support and indexing structure each module 196 is provided with supporting blocks 222 (FIG. 16) at each end of its bottom plate 200 next to each side plate 202. The blocks 222 are engaged by the end plates of the modules 134 to determine and index the vertical position of the modules 134 relative to the modules 196. In addition the wall 162 of each module 134 overlaps and engages the rear side of each of the walls 202 of the two adjacent modules 196 as shown most clearly in FIG. 13.

It will be apparent from FIG. 6 that the module 196 contains two pairs of rollers 136 to facilitate sealing of the rinse water from the fluids of the adjacent development and fix modules.

It will now be apparent that the processing apparatus depicted in FIGS. 6–9 comprises a series of processing modules removably supported in a fully immersed state in a plurality of processing chambers respectively. With respect to each processing module fluid is circulated by a totally immersed pump means to inject fluid Into a web channel on opposite sides of the web. Fluid will be evacuated from the channel when the fluid boundary layer reaches a predetermined thickness to cause the mass transfer rate in the fluid to exceed the mass transfer rate in the web.

Roller transport means between each of the processing modules are also contained in removably supported modules. Indexing and alignment means insure accurate positioning and alignment of the roller transport and processing modules.

To minimize contamination of the processing fluids the apparatus disclosed in commonly assigned application Ser. No. 08/054,487 filed Apr. 27, 1993 by Mark J. Devaney Jr. and John S. Letcher and entitled "Thru-Wall Web Processing Apparatus" may be employed in combination with the apparatus disclosed herein. Such application is cross referenced above and incorporated herein by reference.

Figure 17:
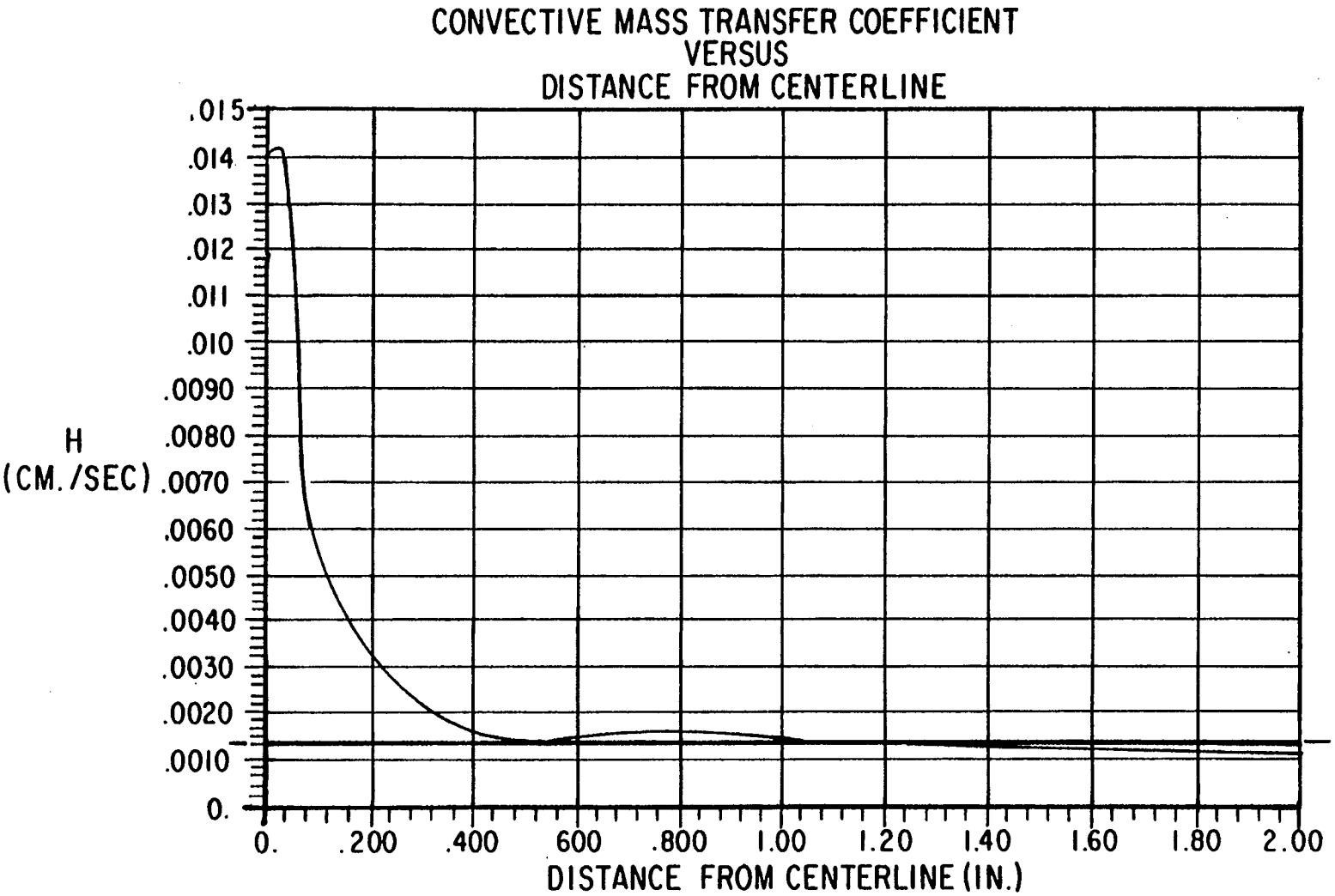
FIGS. 17 and 18 are curves illustrating the results achieved with the invention.

Referring to FIG. 17 of the drawings there is shown a plot of Convective Mass Transfer Coefficient versus Distance From Centerline (distance from the center of the injection slit out to either side). This curve is for a single injection slit pump such as shown in FIGS. 3 and 10. It will be noted that the coefficient is greatest near the slit and decays rapidly as the fluid moves further from the slit. This indicates that multiple short processing cells such as shown in FIG. 6 are much more efficient than one long single cell. In such a short processing cell the distance of the evacuation slit from the injection slit is selected so as to minimize the boundary layer thickness and maintain the mass transfer rate in the fluid greater than the mass transfer rate in the web as disclosed in copending application Ser. No. 07/633,505 cross referenced above.

Figure 18:
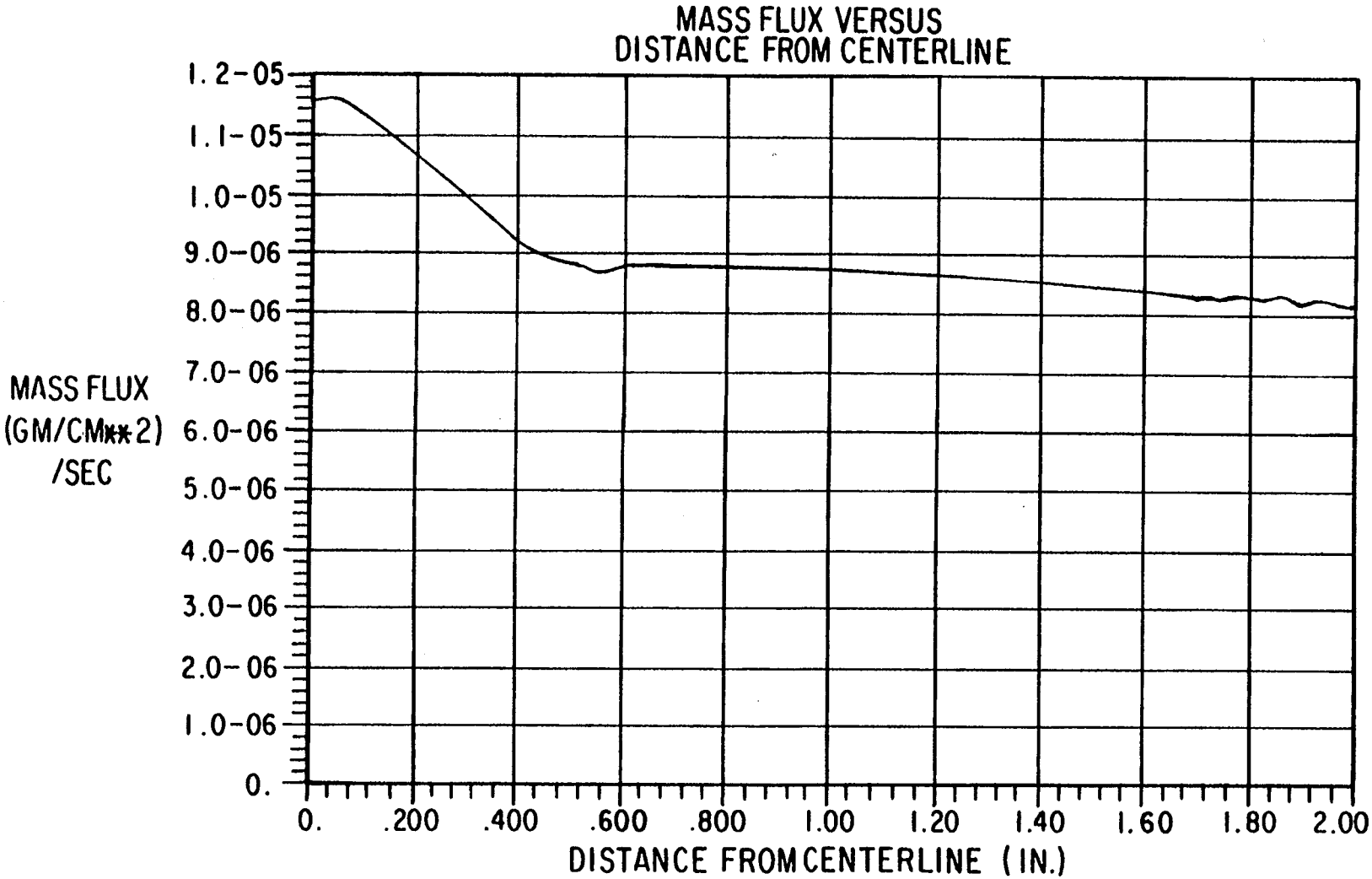

FIG. 18 is a plot of Mass Flux versus Distance from the Centerline for a single injection slit pump such as shown in FIGS. 3 and 10. In this case the mass flux also decays with distance from the centerline of the injection slit. This curve also demonstrates the efficiency of using multiple short processing cells having a distance from the injection slit to the evacuation slit selected to minimize boundary layer thickness.

Those skilled in the art to which the invention relates will appreciate that various substitutions and modifications can be made to the described embodiments without departing from the spirit and scope of the invention as defined by the appended claims.

I claim:

1. In a web processing apparatus having a chamber for containing processing solution, the combination comprising:

means within the chamber defining (1) an elongated channel for movement of a web therethrough, (2) at least one elongated opening extending transversely of said channel for injecting fluid into said channel across the width of a web and (3) at least one elongated evacuation opening extending transversely of said channel for evacuating fluid from said channel across the width of the web; and pump means within said chamber for pumping fluid from said evacuation opening through said chamber to said injection opening.

2. In a web processing apparatus as claimed in claim 1 wherein said pump means is positioned to be totally immersed in the fluid within said chamber.

3. In a web processing apparatus as claimed in claim 2 further including:

manifold means within said chamber for partially enclosing said pump means to define a high pressure fluid zone adjacent said injection opening.

4. In a web processing apparatus as claimed in claim 3, wherein said pump means comprises at least one elongated pump member extending transversely of said channel adjacent said injection opening.

5. In a web processing apparatus as claimed in claim 4 wherein said manifold means comprises:

an elongated manifold member extending transversely of said channel and partially enclosing said pump member to establish said high pressure fluid zone.

6. In a web processing apparatus as claimed in claim 5 wherein said pump member comprises an elongated generally cylindrical hollow rotor having peripheral blades for circulating fluid into one side of the rotor and out the other side of the rotor to said injection opening upon rotation of said rotor.

7. In a web processing apparatus as claimed in claim 2 wherein said pump means comprises:

an elongated housing extending transversely of said channel; and an elongated pump extending transversely of said channel within said housing.

8. In a web processing apparatus as claimed in claim 7 wherein said elongated pump comprises a gear pump.

9. In a web processing apparatus as claimed in claim 8 wherein said housing includes an elongated cavity communicating with the chamber and said injection opening and said gear pump is positioned in said cavity.

10. In a web processing apparatus as claimed in claim 1 or 2 wherein said channel and opening defining means includes at least one pair of said injection openings on opposite sides of said channel for injecting fluid into said channel on opposite sides of the web and at least one pair of said evacuation openings on opposite sides of the said channel for evacuating fluid from said channel on opposite sides of the web.

11. In a web processing apparatus as claimed in claim 10 wherein said pair of injection openings are positioned in juxtaposed relationship with each other.

12. In a web processing apparatus as claimed in claim 11 wherein said pair of evacuation openings are positioned in juxtaposed relationship with each other.

13. In a web processing apparatus as claimed in claim 12 wherein said pair of evacuation openings is spaced from said pair of injection openings by a predetermined distance to evacuate fluid from said channel when the boundary layer of the fluid reaches a predetermined thickness.

14. In a web processing apparatus having a plurality of chambers for containing processing fluids respectively, the combination comprising:

a web processing means for submersion in the fluid in each of said chambers, each of said web processing means comprising (1) an elongated channel for movement of a web therethrough, (2) at least one elongated opening extending transversely of said channel for injecting fluid into said channel across the width of the web, and (3) at least one evacuation opening extending transversely of said channel for evacuating fluid from said channel;

pump means positioned to be immersed in the fluid of each of the chambers for pumping fluid from said evacuation opening through the chamber to said injection opening to contact the web with processing fluid; and transport means for transporting the web from chamber to chamber and through each of said web processing means.

15. In a web processing apparatus as claimed in claim 14 wherein each of said pump means comprises a gear pump including a pair of elongated meshing gear members extending transversely of said channel.

16. In a web processing apparatus as claimed in claim 15 further including gear means for driving one of said gear pump members of each pair.

17. In a web processing apparatus having a chamber for containing processing solution, the combination comprising:

a processing module for submersion in the solution of the chamber, said processing module comprising a pair of juxtaposed housings defining a channel therebetween for passage of a web therebetween;

at least one elongated opening in each of said housings extending longitudinally of said channel for injecting fluid into said channel across the width of the web; and pump means within each of said housings for pumping fluid from the chamber into said housings and into said channel through said injection openings, and further including at least an elongated opening extending transversely of said channel for evacuating fluid from said channel across the width of the web.

18. In a web processing apparatus as claimed in claim 17 further including means on said housings for circulating fluid in said chamber transversely of the web.

19. In a web processing apparatus as claimed in claim 18 wherein said fluid circulating means comprises a plurality of spaced vanes positioned in respective planes inclined at angles relative to the longitudinal axis of the web.

20. In a web processing apparatus as claimed in claim 19 wherein each of said housings has a cavity extending transversely of the channel in communication with the chamber and said injection opening, and said pump means comprises gear pump means in each of said cavities extending transversely of said channel.

21. In a web processing apparatus having a plurality of chambers for containing a plurality of processing fluids respectively, the combination comprising:

web processing means for submersion in the fluid of each of said chambers;

pump means positioned in each of said chambers to be submersed in the processing fluid for pumping fluid from the chamber to said processing means;

roller means between each of the chambers for transporting a web through the chambers;

first drive means for each of said pump means;

second drive means for each of said roller means;

first removable modules for supporting each of said processing means, said pump means and said first drive means as a unit in an operative position within the processing apparatus;

second removable modules for supporting each of said roller means and each of said second drive means as a unit in an operative position within the processing apparatus; and means for indexing the positions of said first and second removable modules.

22. In a web processing apparatus as claimed in claim 21 further including third drive means for engaging and driving each of said first drive means when said first modules are in their operative positions.

23. In a web processing apparatus as claimed in claim 22 further including fourth drive means for engaging and driving each of said second drive means when said second modules are in their operative positions.

24. In an apparatus for processing photosensitive material with processing fluid, the combination comprising:

a chamber for containing the processing fluid;

means disposed within said chamber for forming a processing region for processing photosensitive material, said means having at least one injection port for injecting processing fluid therethrough into contact with at least one side of the photosensitive material;

impeller means disposed within said chamber and submerged within the processing fluid therein for moving the processing fluid; and means for directing the processing fluid moved by said impeller means through said injection port.

25. In apparatus for processing photosensitive material with processing fluid, the combination comprising:

a plurality of chambers, at least one of said chambers containing the processing fluid;

first means for forming a processing region for processing the photosensitive material, said means disposed within said one chamber and having at least one injection port for injecting said processing fluid therethrough into contact with at least one side of the photosensitive material; and second means for forming a high pressure region in the processing fluid adjacent said injection port and for directing said processing fluid within said one chamber from said high pressure region through said injection port, said second forming means comprising:

impeller means disposed within said one chamber and submerged in the processing fluid for moving the processing fluid; and manifold means disposed within said one chamber and having a configuration for directing and moving fluid toward said injection point.

26. In processing apparatus as claimed in claim 25 wherein said first forming means comprises: 1) at least one planar surface, said surface including at least one injection port for injecting said processing fluid therethrough into contact with at least one side of the photosensitive material: and 2) at least one evacuation port for evacuating the processing fluid from said processing region.

27. In a processing apparatus as claimed in claim 26 wherein said means for forming a processing region comprises at least two substantially planar processing surfaces spaced a predetermined distance apart so as to define a channel for receiving the photosensitive material, said means defining at least one injection port in at least one of said surfaces for injecting processing fluid into said channel and at least one evacuation port in at least one of said surfaces for evacuating processing fluid from said channel into said chamber.

28. In a processing apparatus as claimed in claim 27 wherein said injection port comprises at least one opening extending transversely of said channel for injecting said processing fluid into said channel across the width of said channel.

29. In a processing apparatus as claimed in claim 28 wherein said injection port comprises a single elongated opening.

30. In a processing apparatus as claimed in claim 27 wherein both said planar surfaces includes an injection port for injecting processing fluid into said channel into contact with opposite sides of the photosensitive material respectively, and wherein the spacing of said planar surfaces defines an evacuation opening at each end of said channel for evacuating fluid from said channel.

31. In a processing apparatus as claimed in claim 30 wherein said evacuation openings are spaced from a said injection ports by a predetermined distance to evacuate processing fluid from said channel when the boundary layer of the processing fluid reaches a predetermined thickness.

32. In apparatus for processing photosensitive material with processing fluid, the combination comprising:

a chamber for containing the processing fluid;

a housing disposed within said chamber, and comprising means for forming a processing region, said means comprising at least one substantially planar surface for receiving a photosensitive material, said surface having at least one opening for injecting the processing fluid therethrough so as to contact one side of said photosensitive material; and means disposed within said housing and submerged within said processing fluid for moving and directing the processing fluid within said chamber through said injection opening into contact with at least one side of said photosensitive material, said housing further defining a cavity, said cavity extending transversely of said planar surface and in communication with said chamber and said injection opening.

33. In processing apparatus as claimed in claim 32 wherein said processing fluid moving means comprises a pair of rotatably movable gear pump elements disposed within said cavity, said gear pump elements being engageable in opposing directions to draw processing fluid from within said chamber into said cavity.

34. In apparatus for processing photosensitive material with processing fluid, the combination comprising:

a chamber for containing the processing fluid;

a housing disposed within said chamber, and comprising means for forming a processing region, said means comprising at least one substantially planar surface for receiving a photosensitive material, said surface having at least one opening for injecting the processing fluid therethrough so as to contact one side of said photosensitive material; and means disposed within said housing and submerged within said processing fluid for moving and directing the processing fluid within said chamber through said injection opening into contact with at least one side of said photosensitive material, said processing region further comprising at least one evacuation port for evacuating said processing fluid from said processing region into said chamber.

35. In apparatus for processing photosensitive material with processing fluid, the combination comprising:

a chamber for containing the processing fluid;

a processing module disposed within said chamber, said module comprising:

a pair of juxtaposed housings defining a channel therebetween for receiving the photosensitive material, said housings having at least one opening extending transversely of said channel for injecting the processing fluid into contact with least one side of the photosensitive material, and at least one opening for evacuating the processing fluid from said channel; and means disposed within at least one of said housings for directing processing fluid from said chamber through said injection opening under pressure into contact with the photosensitive material, said one housing having a cavity in communication with said chamber and said injection opening, said directing means comprising gear pump means extending transversely of said channel and disposed with said cavity, said one housing being submerged within said processing fluid.

36. In an apparatus as claimed in claim 35 further comprising means for circulating the processing fluid within said chamber from said evacuation opening toward said gear pump means for producing a closed loop path for processing fluid.

37. In apparatus as claimed in claim 36 said circulating means comprises a plurality of spaced fin-like elements disposed along the exterior surface of at least said one housing, said fin-like elements having a configuration for directing said processing fluid toward said gear pump means.

38. In apparatus as claimed in claim 35 wherein said apparatus further comprises a plurality of chambers, at least one of which contains the processing fluid and said processing module for receiving and processing the photosensitive material.

39. In apparatus as claimed in claim 38 wherein said apparatus further comprises means between each said chamber for transporting the photosensitive material.

40. In apparatus for processing photosensitive material with processing fluid, the combination comprising:

a plurality of chambers, at least one of which for containing processing fluid therein;

means disposed within said one chamber for forming a processing region, said means having at least one injection port for injecting said processing fluid therethrough into contact with at least one side of the photosensitive material;

impeller means disposed within said chamber and submerged within said processing fluid for moving said processing fluid; and means for directing said processing fluid being moved by said impeller means through said injection port, and further comprising means between each of said chambers for transporting photosensitive material therethrough.

41. In apparatus for processing photosensitive material with processing fluid, the combination comprising:

a plurality of chambers, at least one of which for containing processing fluid therein;

means disposed within said one chamber for forming a processing region, said means having at least one injection port for injecting said processing fluid therethrough into contact with at least one side of the photosensitive material;

impeller means disposed within said chamber and submerged within said processing fluid for moving said processing fluid; and means for directing said processing fluid being moved by said impeller means through said injection port, and further comprising:

first means for driving said transport means; and second means for driving said means for moving and directing said processing fluid toward said processing region.

* * * * *